US005703561A

United States Patent [19]

Yamamoto et al.

[11] Patent Number: 5,703,561

[45] Date of Patent: Dec. 30, 1997

[54] RESISTOR DEVICE

[75] Inventors: Shuko Yamamoto, Sano; Takeya Osakada, Kasukabe; Iwao Tsugi, Kodaira, all of Japan

[73] Assignee: Calsonic Kohwa Co., Ltd., Tokyo, Japan

[21] Appl. No.: 693,006

[22] Filed: Aug. 6, 1996

[30] Foreign Application Priority Data

Dec. 27, 1995 [JP] Japan ..... 7-341680
Feb. 28, 1996 [JP] Japan ..... 8-041748

[51] Int. Cl.[6] ..... H01C 1/08

[52] U.S. Cl. ..... 338/53; 338/50

[58] Field of Search ..... 338/22 R, 24, 338/50, 51, 53, 55, 92, 95, 220, 221, 260, 307, 308, 309, 315, 328; 361/23, 24, 25, 27

[56] References Cited

U.S. PATENT DOCUMENTS

| | | | |
|---|---|---|---|
| 4,265,597 | 5/1981 | Payne et al. | 417/32 |
| 4,935,717 | 6/1990 | Osawa et al. | 338/51 |
| 5,192,937 | 3/1993 | Lee | 337/104 |
| 5,218,336 | 6/1993 | Murakami | 338/328 |
| 5,229,741 | 7/1993 | Black, III | 338/50 |
| 5,268,665 | 12/1993 | Iwao | 338/22 R |
| 5,274,351 | 12/1993 | Lee | 338/221 |
| 5,291,174 | 3/1994 | Zirnheld et al. | 338/24 |
| 5,550,527 | 8/1996 | Lee | 338/50 |
| 5,563,570 | 10/1996 | Lee | 338/50 |

FOREIGN PATENT DOCUMENTS

| | | |
|---|---|---|
| S59-167715 | 11/1984 | Japan . |
| H1-125707 | 8/1989 | Japan . |
| H4-46671 | 2/1992 | Japan . |
| 1466569 | 3/1977 | United Kingdom . |
| 2205455 | 12/1988 | United Kingdom . |

*Primary Examiner*—Adolf Berhane
*Attorney, Agent, or Firm*—Wigman, Cohen, Leitner & Myers, P.C.

[57] ABSTRACT

A resistor device can be cheaply produced without a troublesome processing and without a complicated manufacturing process, obtaining a construction which has a stable efficiency. The resistor body 24 which can change a resistance value by selecting a plurality of end portions is clamped between a pair of the insulation sheets 31*a*, 31*b*. Moreover, both of these insulation sheets 31*a*, 31*b* are clamped between a pair of cover plates 32*a*, 32*b*. The end portion of the resistor body 24 is connected to the electric conductor piece 26 fixed to the base 25 and the first, second, and fourth terminals 27, 28, 30. The fuse 43 is provided between the electric conductor piece 26 and the third terminal 29.

1 Claim, 16 Drawing Sheets

RESISTOR DEVICE

TITLE OF THE INVENTION

1. Field of the Invention

The present invention relates to a resistor device to be built in the air conditioner for vehicle, and to regulate the ventilation quantity of the fan of the air conditioner.

2. Description of the Prior Art

The air conditioner for vehicle to harmonize the air inside the vehicle room sends (ventilates) air into the vehicle room after the air is taken into a duct where the temperature of the air is adjusted. By regulating the rotating speed of the fan in the duct in a plurality of steps, the ventilation quantity is adjusted to an expected quantity according to the selected rotating speed. Japanese Utility Model First Publication KOKAI No. S59-167715 discloses one example of these air conditioners for vehicle as shown in FIG. 27.

Air inlets 2*a*, 2*b* are provided in an upstream end (left end in FIG. 27) of the duct 1, and air outlets 3*a*, 3*b*, 3*c* are provided in a downstream end (right end in FIG. 27) of the duct 1. One of the air inlets 2*a*, 2*b* intakes the inside air, and the other intakes the ambient air. Each of the air outlets 3*a*, 3*b*, 3*c* is connected to a defrost opening, benchration opening, and an under leg opening. In the duct, the fan 4, evaporator 5, and heater core 6 are placed in series successively from upstream. A bypass passage 7 is provided on a side of the heater core 6 (upper side in FIG. 27). Further, there is an air-mixing chamber 8 on the downstream side of these heater core 6 and bypass passage 7. Moreover, the air inlets 2*a*, 2*b*, the bypass passage 7, and air outlets 3*a*, 3*b*, 3*c* are provided with a door 9*a* to 9*e*, respectively, so that the air flowing route can be freely selected.

When the air conditioner is used, the doors 9*a* to 9*e* are rotated to a predetermined position while the fan 4 is operated. After air took from at least one of the above air inlets 2*a*, 2*b* has passed through the evaporator 5, it is passed through one or both of the heater core 6 and bypass passage 7. The air adjusted to a desired temperature in the air-mixing camber 8 is sent to the vehicle room from a desired outlets 3*a* to 3*c* (at least one of them), according to the open and shut condition of the respective doors 9*c* to 9*e*.

The ventilation quantity of the air at the desired temperature sent to the vehicle room is adjusted by changing the rotating speed of the fan 4. Because of this, a control device to change the rotating speed in a plurality of levels is established in the fan 4. With the control device, the rotating speed of the electric motor for the fan 4 is switched to a plurality of levels, for example, to a high speed (Hi), medium high speed (Mh), medium low speed (ML), or low speed (Lo), so that the ventilation quantity by the fan 4 is adjusted. The adjustment of ventilation quantity can be achieved by operating a switch provided in an instrument panel etc., or by automatically doing according to a load of the air conditioner fixed by a difference in temperature between the set temperature and the indoor temperature etc.

The controller has a resistor device installed to change the voltage applied to the electric motor. Moreover, for example, Japanese utility Model First Publication KOKAI No. H1-125707 discloses a resistor device of the controller for the fan in the air conditioner for vehicle. FIG. 28 shows a resistor device enclosed in the KOKAI Publication. The resistor device 10 is comprised of a resistor body 12 on a flat insulation base plate 11 in a meandered condition as shown to secure the total length. Generally speaking, used as the insulation base plate 11 is an enamel member comprising an iron plate and a glass material which is an insulation member to cover the front and back faces of the iron plate. Further, the resistor body 12 is composed of an appropriate electric conducting member coated in a film shape on the insulation base plate 11, by a method shown from the prior art, for example, screen printing, spattering etc.

The resistor body 12 is provided with connecting parts 13*a* to 13*d* at both end portions and central portions at four locations in total. Specifically, the connecting parts 13*a*, 13*d* at the opposite end portions are located at the both corners of a side edge portion (upper side edge portion in FIG. 28) of the insulation base plate 11. Moreover, the central connecting parts 13*b*, 13*c* extend to a central location in the side edge portion of the insulation base plate 11 from two locations in the central portion of the resistor body 12. And, the connecting parts 13*a* to 13*d* are connected with terminals 14*a* to 14*d*, respectively. These terminals 14*a* to 14*d* are electrically conducted to the contacts 15*a* to 15*d* of a change over switch 20 provided in the instrument panel etc. respectively.

The resistor device 10 composed as mentioned above is connected in series with reference to the change over switch 20, the power supply (battery) 16, the fuse 18 and the electric motor 17 of the fan 4 as shown in FIG. 28. For example, if the fan 4 can not be rotated with some reasons when the electric motor 17 is rotated at high speed, the fuse 18 is melted so as to prevent any damage of the electric motor 17. Moreover, in the resistor body 12 of the resistor device 10, another fuse 19 is likewise provided to disconnect the circuit when the fan 4 is stopped under power. The fuse 19 is melted to stop the power supply to the electric motor 17 when the fan 4 can not rotate with some reasons so that air can not flow into the duct 1 (see the FIG. 27). Because of this, the resistor device 10 is provided in the duct 1 along the air flowing direction in it (with the face of the insulation base plate 11 aligned to the air flowing direction). The fuse 19 can not be melted while the fan 4 is normally operated so that air flows into the duct 1, because the temperature rise of the fuse 19 is limited. Oppositely, when the fan 4 stops in spite that the electric motor 17 is placed under power, the temperature of the fuse 19 rises and the fuse 19 is melted, so that the power supply to the electric motor 17 is stopped.

When the fan 4 is operated by the controlling circuit having the resistor device 10 so that the air controlled to the desired temperature by the air conditioner for vehicle flows into the vehicle room, its operation and effects are as follows. First of all, the contact terminal 21 of the changeover switch 20 is connected to one of the contacts 15*a* to 15*d* to obtain the ventilation quantity which the rider desires. For example, when the contact terminal 21 is connected to the contact 15*a* (Hi) provided on the most left side in FIG. 28, the electric motor 17 is operated in the condition that the voltage does not fall due to the resistor device 10. Consequently, the electric motor 17 rotates at a high speed, and the ventilation quantity of the fan 4 becomes to a maximum.

When the contact terminal 21 is connected to the contact 15*b* (Mh), the portion of the connecting parts 13*a* to 13*b* shown by cross hatchings in FIG. 28 in the resistor body 12 of the resister device 10 functions as an electric circuit portion connected to the circuit in series. Accordingly, the voltage applied to the electric motor 17 decreases in proportion to a voltage drop according to the resistance value of this part, so that the rotating speed of the electric motor 17 decrease in proportion to it. Because of this, the ventilation quantity of the fan 4 decreases from the state when the "Hi" is selected. When the contact terminal 21 is connected to the contacts 15*c* (ML) and 15*d* (Lo), the length of parts operating as the electric circuit of the resistor body 12 becomes long. That is, when the contact terminal 21 is connected to the contact 15*c*, the portion from the connecting parts 13*a* to 13*c* of the resistor body 12 operates as an electric circuit portion. Moreover, when the contact terminal 21 is connected to the contact 15*d*, the total length of the resistor body 12 (the portion from the connecting part 13*a* to the connecting part 13*d*) operates as an electric circuit portion. In this way, because the resistance value increases as the electric circuit becomes long, the voltage applied to the electric motor 17 decreases in proportion to it, and the ventilation quantity of the fan 4 decreases from the state mentioned above.

In case of the prior art resistor device 10 that is composed and operated as mention above, the fuse 19 to stop the power supply to the electric motor 17 when the fan 4 can not rotate, is made of a solder metal that melts at a comparatively low temperature. When the fuse 19 melts as the temperature rises, it is necessary that the molten solder does not span the discontinuation part 22 of the resistor body 12 to securely stop the electric passage of the resistor body 12. In case of the prior art construction shown in FIG. 28, the tip portion (left end portion in FIG. 28) of the spring piece 23 is suppressed by the fuse 19. When the fuse 19 is melted, the spring piece 23 can flips the solder from the insulation base plate 11. However, in case of the construction as mentioned above, the possibility that a remained portion of solder is suspended across the discontinuation part 22. Moreover, there is a problem of durability in the spring piece 23.

Because of this, generally in the prior art, the solder is prevented from spanning the discontinuation part 22 by utilizing the surface tension of molten solder without providing the spring piece 23. That is, at least the discontinuation part 22 and the neighboring parts on the surface of the insulation base plate 11 are covered by a material which is hardly wetted (the contact degree is large) with the molten solder. Because of this, when the solder of the fuse 19 is melted, the molten solder becomes round and is stuck to an end portion of the resistor body 12, or it flows downward so as to securely prevent the discontinuation part 22 from being electrically connected.

In this way, because the discontinuation part 22 to which the solder material of the fuse 19 is applied is covered by a material which is hardly wetted by the solder material, when the resistor device 10 is assembled, the fuse 19 is hardly stuck to the discontinuation part 22. That is, the molten solder does not stick to the discontinuation part 22, moreover, the not-melted solder does not stick to. Because of this, in the prior art, the solder must be placed in a half molten condition for application to the discontinuation part 22 to form the fuse 19.

In the prior art resistor device 10 composed and operated as mentioned above, it was difficult to install the fuse 19 in it, and costs were inevitably increased. The reason is that as mentioned above, the solder must be stuck to the discontinuation part 22 of the resistor body 12 in a half-molten condition. That is, in order that the solder that is not a solid material nor a liquid material is stuck, it is necessary to control very strictly the temperature of the solder within plus or minus 1 degree centigrade, desirably plus or minus 0.5 degrees centigrade, for example, as described in Japanese Patent First Publication KOKAI No. H4-46671.

Moreover, in case of the prior art resistor device 10, as the resistor body 12 is provided on the surface of the insulation base plate 11 made of enamel, a manufacturing process of the insulation base plate 11 provided with the resistor body 12 is complicated (through a plenty of processes), the costs of resistor device 10 were inevitably high in the point of the total manufacture process.

SUMMARY OF THE INVENTION

An object of the present invention is to provide a resistor device in view of these circumstance, wherein while the manufacture process is decreased, the reduction of costs is attempted by easily performing the installation operation of the fuse without troublesome temperature control.

Another object of the present invention is to provide a resistor device for an air conditioner fan having a combination of a resistor body to generate heat to melt a fuse, insulation sheets, cover plates and electric conductor piece and terminals, to form a space to accommodate the fuse to securely cease power supply for the fan when stopped under power.

DETAILED DESCRIPTION OF THE PREFERRED EMBODIMENTS

Figure 1:
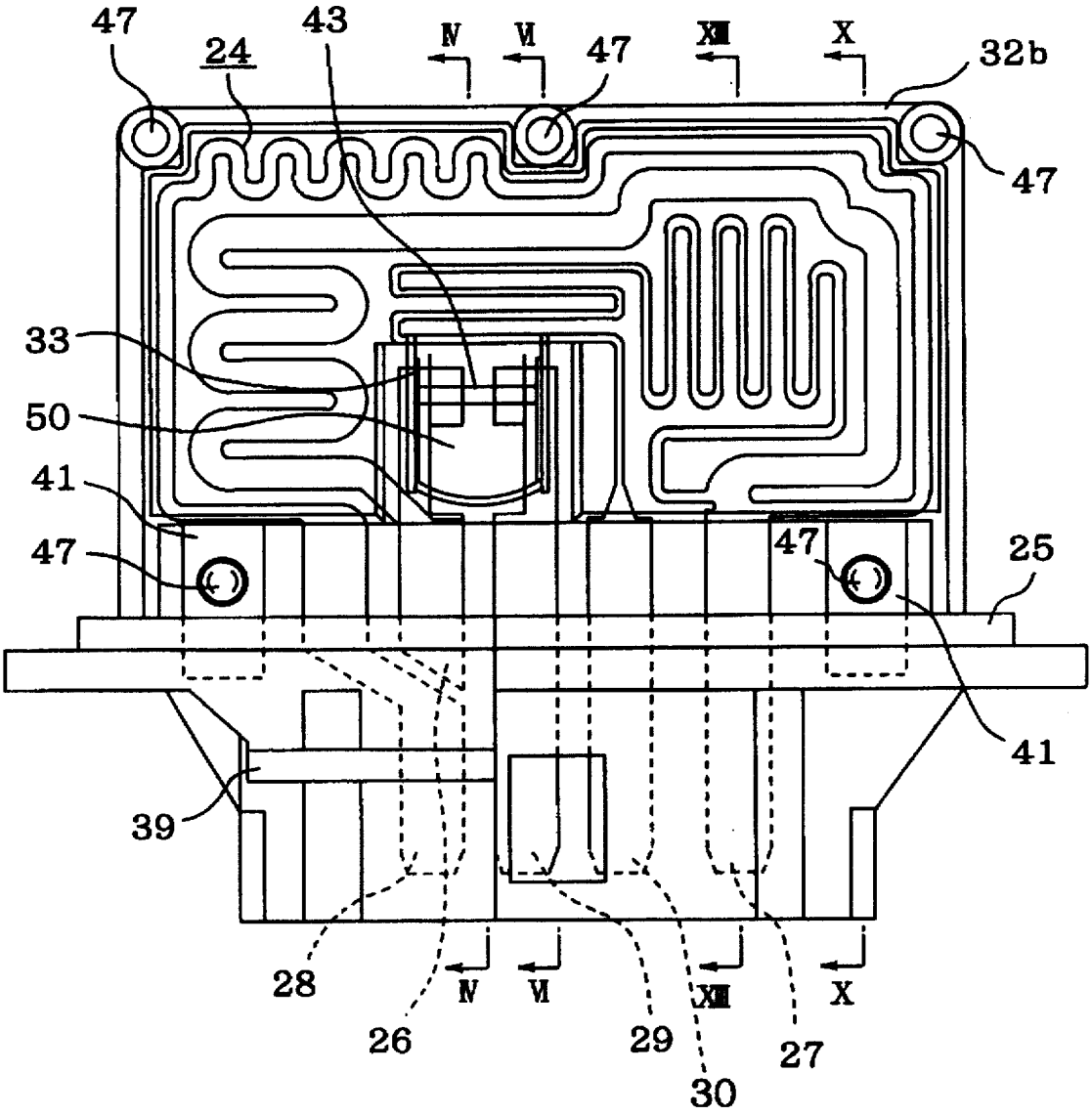
FIG. 1 is a partial see through elevation view of an embodiment of a resistor device according to the present invention.
Figure 2:
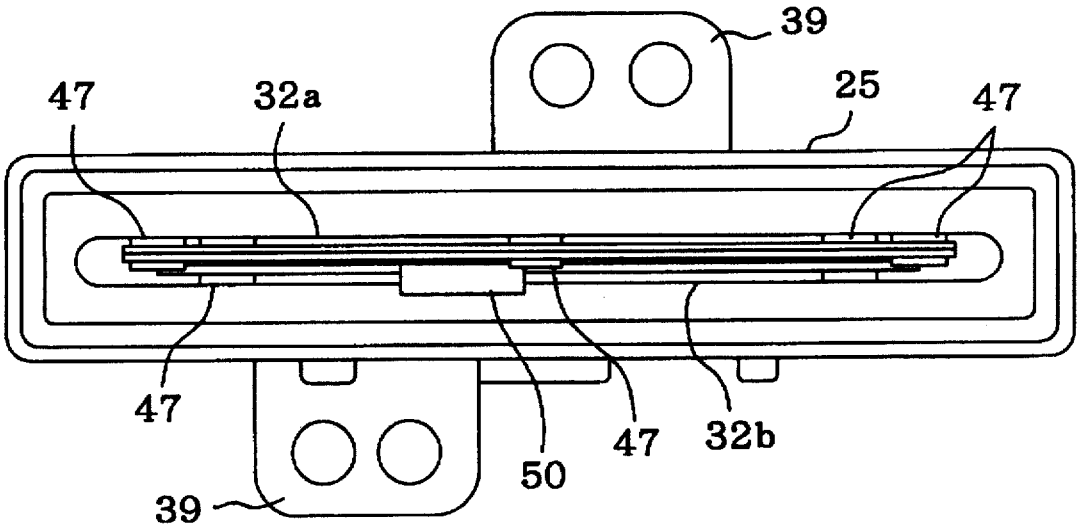
FIG. 2 is a plan view of FIG. 1.
Figure 3:
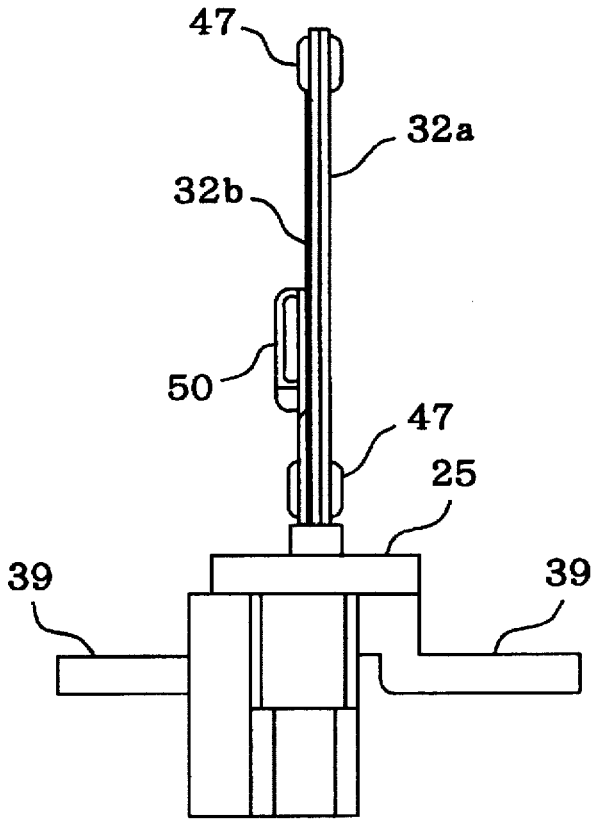
FIG. 3 is a right side elevational view of FIG. 1.

The resistor device in the present invention basically comprises a resistor body, a base, an electric conductor piece, a first to third terminals, a fuse, a pair of insulation sheets, a pair of cover plates, and an inlet opening. The resistor body has at least three end portions, so that it has a first resistance value between the first and the second end portions, and a second resistance value between the first and third end portions which is different from the first resistance value respectively.

The base is made of an insulation member which is for example, polyamide resin etc. strengthened by a reinforcement member of glass fiber etc.

The electric conductor piece has its base half portion embedded in the base, and its tip half portion exposed from the base and connected to the first end portion.

The first to the third terminals have each a central portion embedded in the base, and, the inner end portion of the first terminal is connected to the second end portion of the resistor body. Further, the inner end portion of the second terminal is connected to the third end portion of the resistor body. Moreover, the third terminal is provided adjacent to and spaced from the electric conductor piece.

The fuse is made of a low-melting point metal of solder etc. and provided between the third terminal and the electric conductor piece.

The pair of the insulation sheets is provided to clamp the fuse, the resistor body, the inner end portions of the first to third terminals, and the tip half portion of the electric conductor piece between them.

The pair of cover plates is made of a metal which is good in heat conduction, for example, aluminum alloy plate etc. and clamp the pair of the insulation sheets between them.

Further, the inlet opening is formed in a part of one of the cover plates corresponding to the fuse so as to introduce part of the air flowing outside the cover plates to the interior defined by the cover plates.

The resistor device of the present invention is built in the controller circuit of the electric motor for fan of the air conditioner for vehicle like the prior art resistor device, to control the voltage applied to the electric motor. When the control is done, the operation is almost the same as the construction in the prior art. Moreover, the resistor device in the present invention is likewise installed into the duct of the air conditioner for vehicle as the resistor device in the prior art is. And, the resistor device provided in a direction so as not to form a big resistance for the air flowing into the duct. In case of the resistor device of the present invention, the air flowing into the duct is efficiently taken into the inside of the cover plates from the inlet opening with the resistor device being provided in this way.

While the fan is operated normally and the air flows in the duct, the fuse is cooled by the air which is introduced to inside the cover plates via the inlet opening. The fuse therefore does not melt down. On the other hand, when the fan does not rotate in spite of power being supplied thereto, then as described hereunder, the fuse melts down so that the power supply to the fan stops.

If the fan stops so that the air ceases to flow in the duct, the cooling air is not supplied via the inlet opening to the interior portion housing the fuse. The resistor body however continues to produce Joule heat due to the continuation of power to the fan. This heat is transmitted through the cover plates to the mounting portion of the fuse so that the temperature of the fuse increases. As a result, the fuse melts down, stopping the power supply to the fan, thus preventing damage to the electric motor for the fan.

In this way, with the resistor device of the present invention, while the construction is such that the fuse can be located away from the resistor body, when the rotation of the fan stops while under power, the temperature of the fuse can still be effectively raised by heat from the resistor body and reliably melted down. Moreover, since the fuse can be located away from the resistor body, then under normal times, the fuse is not easily influenced by heat from the resistor body so that the life of the fuse can be improved.

The resistor body is made in a form of a separate thin plate. It is thus not necessary to form the resistor body on the surface of the insulation substrate. Consequently, the number of manufacturing steps is reduced so that costs can be reduced. Moreover, the operation of installing the fuse between the third terminal and the conductor piece is carried out by normal soldering thus avoiding troublesome temperature control. Consequently, costs can also be reduced from the point of view of temperature control at the time of fitting the fuse.

FIGS. 1 to 25 show one example of the structure of an embodiment of the present invention. The resistor device of the present invention, as will be clear from the partial see through elevation view of FIG. 1 and from the exploded perspective view of FIG. 12, comprises a resistor body 24, a base 25, a conductor plate 26, first through fourth terminals 27 to 30, a fuse 43, a pair of insulation sheets 31*a*, 31*b*, a pair of cover plates 32*a*, 32*b*, and an inlet opening 33.

Figure 13A:
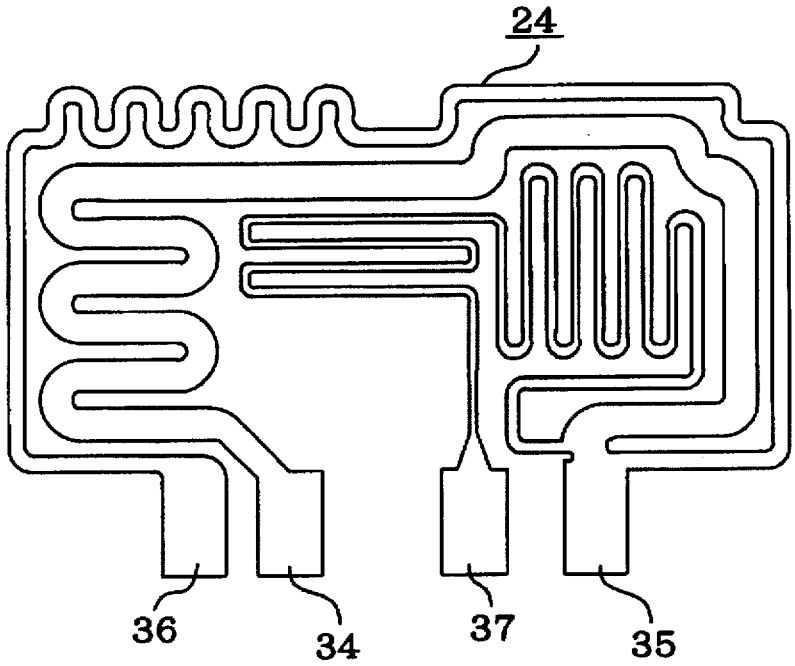
FIG. 13(A) is an elevation view showing the form of a resistor body assembled into the resistor device after completion.
Figure 13B:
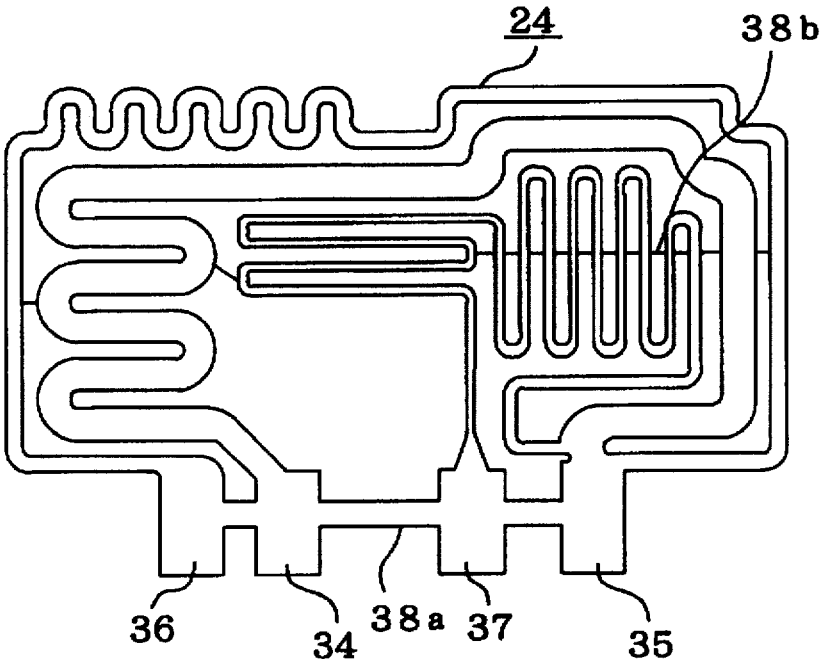
FIG. 13(B) is an elevation view showing the form of a resistor body immediately after etching.

The resistor body 24 is formed in a shape such as shown in FIG. 13(A), by for example etching a very thin stainless steel plate (for example of a thickness around 0.1 mm). With the example shown in the figures, the resistor body 24 has first through fourth ends 34 to 37 at four locations. The first end 34 located second from the left in FIG. 13(A) is connected for example to an electric motor 17 of a fan 4 (see FIG. 28) via the fuse 43 and the conductor plate 26. That is to say, the first end 34 corresponds to the connecting portion 13*a* in the conventional construction shown in FIG. 28. The resistance values between the first end 34, and the ends at the remaining three locations, that is to say the second through fourth ends 35 to 37, are made different from each other.

A first resistance value between the first end 34 and the second end 35 farthest to the right in FIG. 13 is made a minimum. A second resistance value between the first end 34 and the third end 36 farthest to the left in FIG. 13 is made an intermediate value. A third resistance value between the first end 34 and the fourth end 37 second from the right in FIG. 13 is made a maximum value. These first through third resistance values are adjusted by the width and the length of the resistance path (electrical path) between the first end 34 and the second through fourth ends 35 to 37.

The resistor body 24 has the form shown in FIG. 13(A) once completed. However in order to improve handling at the time of assembly, it is left in the form shown in FIG. 13(B) at completion of the etching. That is to say, the first through fourth ends 34 to 37 and the resistance paths are respectively connected by connecting portions 38*a* and 38*b* so as to prevent excessive warping of the thin resistor body 24 at the time of assembling in the resistor device. Of course these connecting portions 38*a*, 38*b* are removed once the resistor body 24 has been assembled into a predetermined location.

The base 25 is made from an insulation material such as polyamide resin, strengthened with a reinforcing material such as glass fibre. At the time of assembling the resistor device into an air conditioning unit, the base 25 is fixed to the side wall of a duct of the air conditioning unit. The base 25 has a pair of attachment flanges 39. When the resistor device is fitted to the air conditioning unit, the main body of the resistor device (the portion above the base 25 in FIG. 1) is inserted into the duct through an opening formed in the side wall, and the attachment flanges 39 are then secured to the outside face of the side wall with screws.

Figure 12:
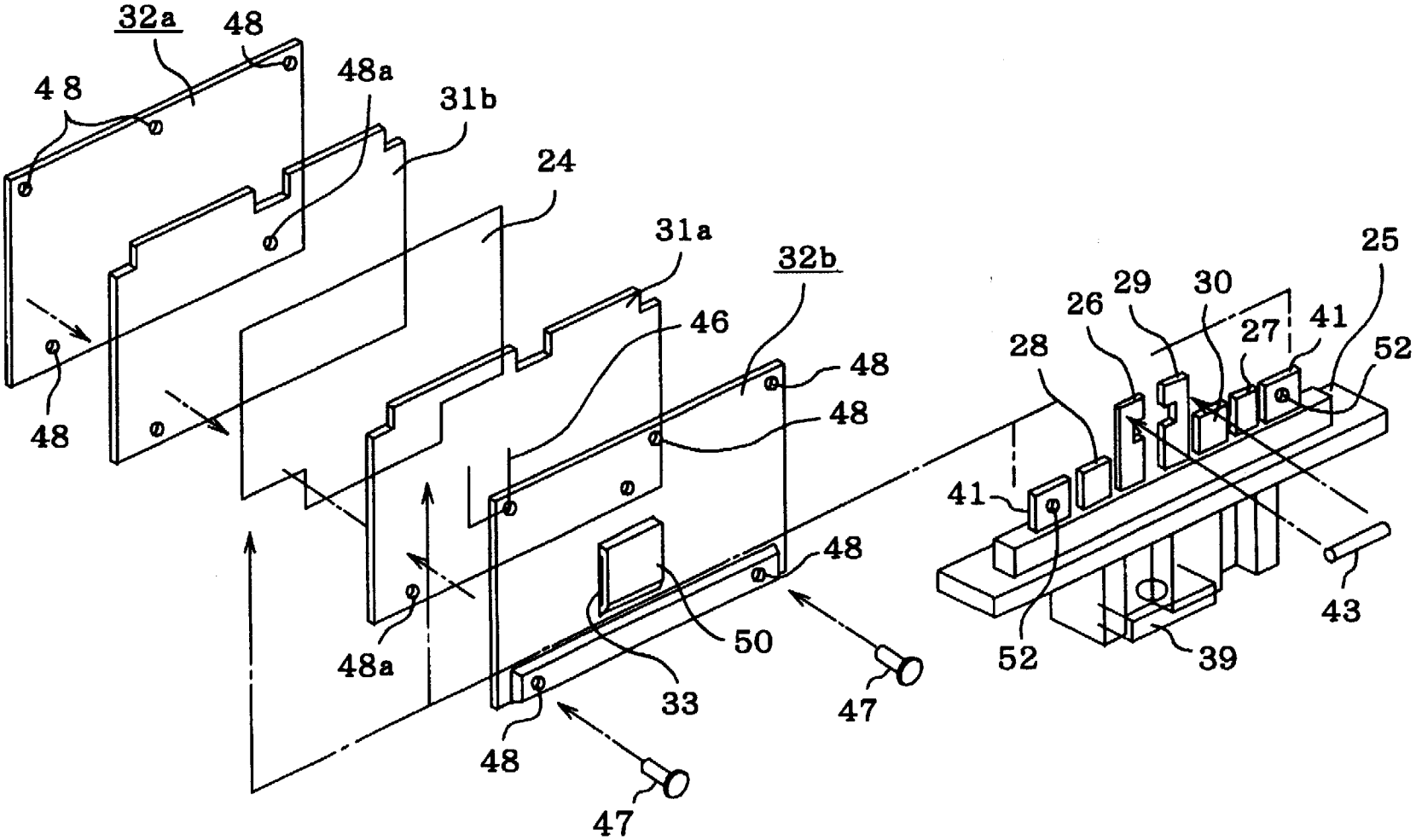
FIG. 12 is an exploded perspective view showing the embodiment of the resistor device of the present invention.
Figure 14A:
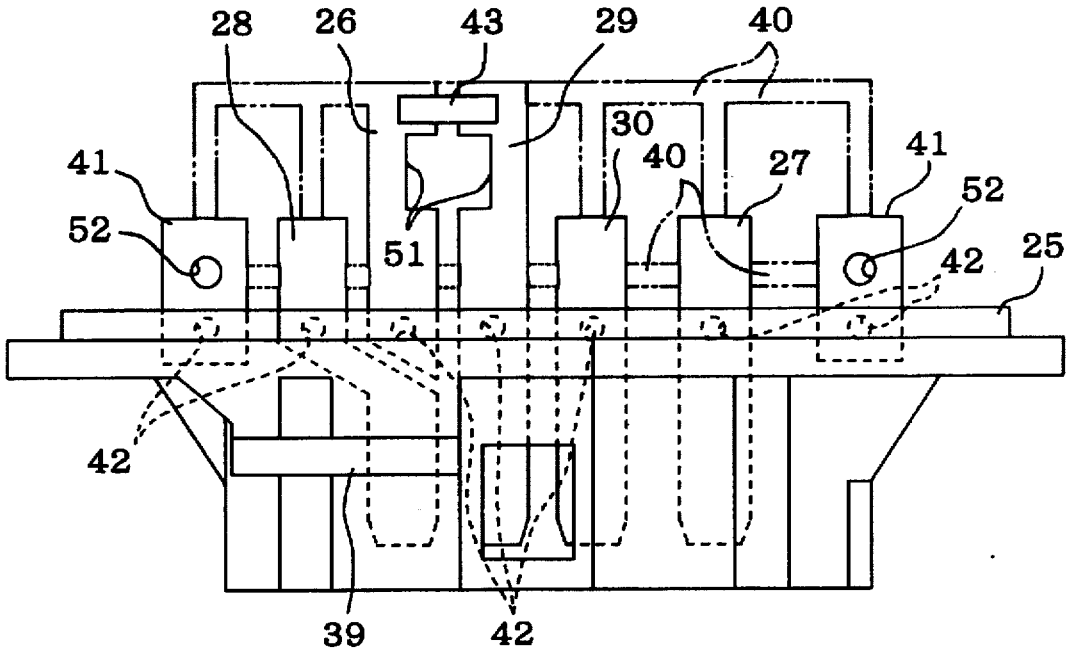
FIG. 14(A) is a plan view showing; a conductor plate, first through fourth terminals, and attachment plates, embedded in a base with connecting portions removed.
Figure 14B:
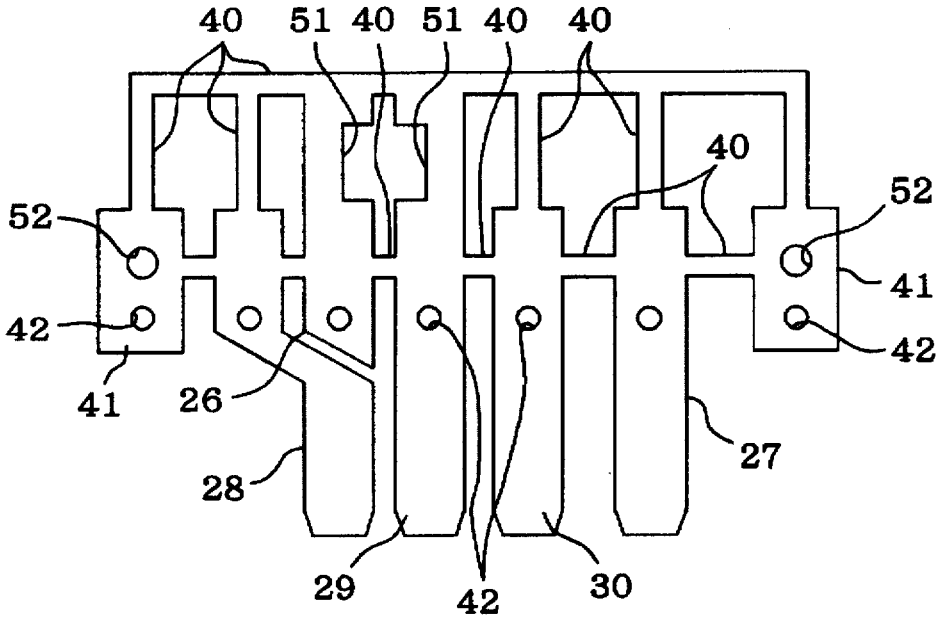
FIG. 14(B) is a plan view showing; the conductor plate, the first through fourth terminals, and the attachment plates, in an as punched condition.

With the base 25 constructed as described above, a part of the conductor plate 26, and respective parts of the first through fourth terminals 27 to 30 are embedded in the base 25 at the time of injection moulding thereof. The conductor plate 26 and the first through fourth terminals 27 to 30 are made by punch forming a brass plate (conducting metal plate) using a press, after which they are embedded in the base 25 as shown in FIG. 12 and FIG. 14(A). In order to simplify the embedding operation, the initial punched blank as shown in FIG. 14(B) has the respective members 26 to 30 connected together with connecting portions 40, thus enabling handling as a single body. Then after embedding the members 26 to 30 in the base 25, the connecting portions 40 are removed by a suitable process such as press cutting, electric discharge machining, or laser beam machining.

Moreover, with the example shown in the figures, a pair of attachment plates 41 are provided at opposite ends of the base 25, and these attachment plates 41, together with the members 26 to 30, are connected by the connecting portions 40 up until completion of the embedding process. The attachment plates 41 are used for securing the cover plates 32*a*, 32*b* to the base Respective apertures 42 are formed in the portions of the attachment plates 41 and the members 26 to 30 which are embedded in the base 25. During the embedding operation, the synthetic resin forming the base 25 flows into the apertures 42, thereby improving the attachment strength between the base 25 and the members 26 to 30, and the attachment plates 41.

Of the members 26 to 30, and the attachment plates 41 embedded in the base 25 as described above, the conducting plate 26 has a base half thereof (lower half in FIGS. 1, 14 and 25) embedded in the base 25, while the tip half thereof (upper half in FIGS. 1, 14 and 25) is connected at the portion exposed from the base 25, to the first end 34 of the resistor body 24. Any method of connection is adopted provided that electrical conduction between the members 26 and 34 can be ensured. For example, this may involve spot welding or soldering, while to reduce costs, ultrasonic bonding may be considered. However, in carrying out ultrasonic bonding, it is difficult to simply bond the stainless steel resistor body 24 which is extremely thin (for example around 0.1 mm thick) to the brass conductor plate 26 which is relatively thick (for example around 1 mm thick). Therefore the surface of the conductor plate 26 is nickel plated at least over the portion to be connected to the first end 34, and the resistor body 24 and the conductor plate 26 are then ultrasonic bonded through the medium of the nickel plate layer.

Figure 25:
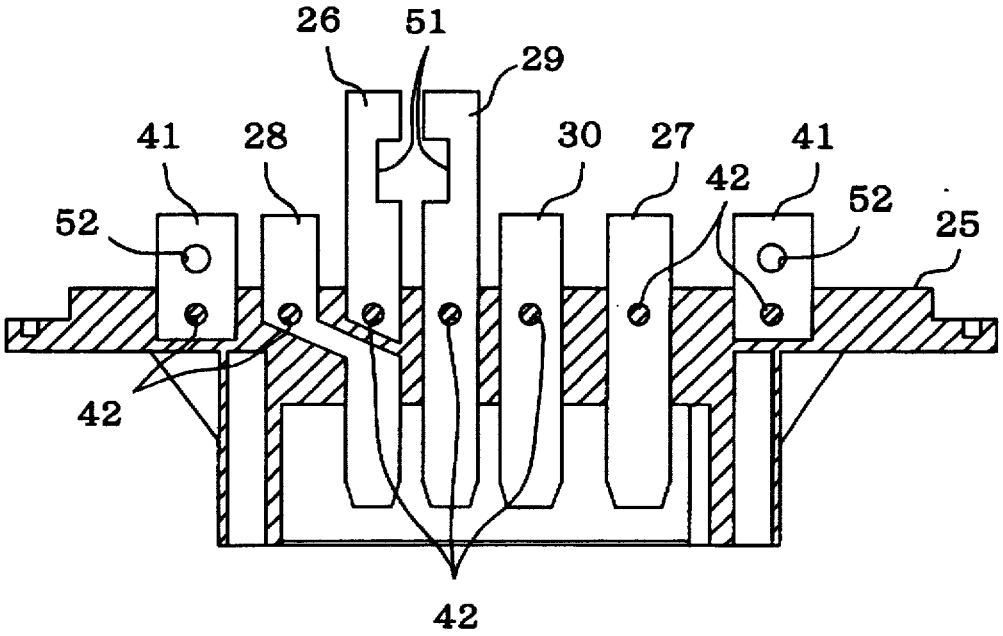
FIG. 25 is a sectional view taken along the line XXV—XXV of FIG. 24.
Figure 27:
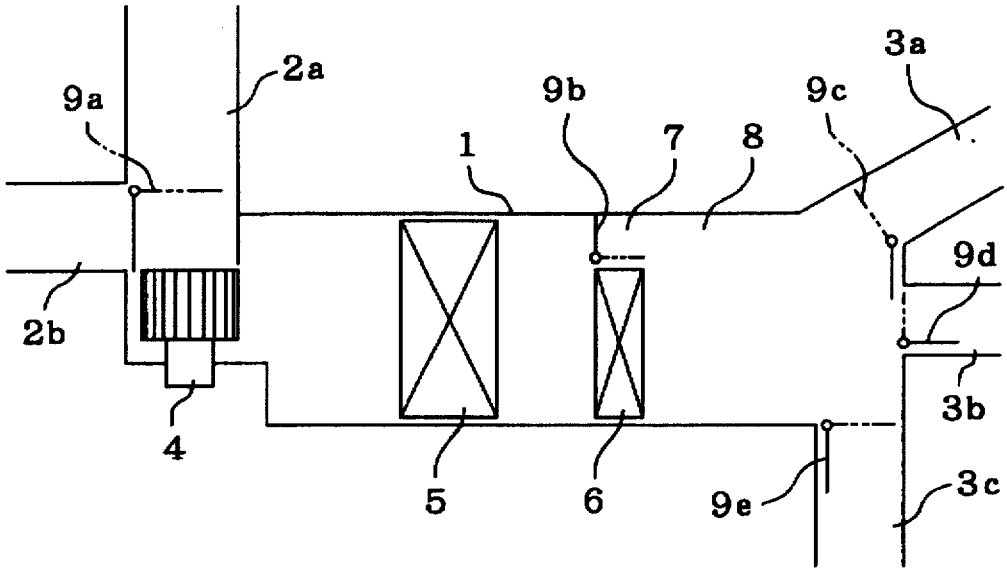
Fig 27 PRIOR ART
FIG. 27 is a schematic sectional view of an example of an automotive air conditioning unit relevant to the present invention, with the resistor device fitted thereto.

The first through fourth terminals 27 to 30 have the central portions thereof embedded in the base 25. Moreover, the inner end of the first terminal 27 farthest to the right in FIGS. 1, 14 and 25 (namely the end which becomes the inside end in the duct 1 (FIG. 27) when fitted to an air-conditioning unit; the upper end in FIGS. 1, 14 and 25) is connected to the second end 35 of the resistor body 24. Moreover, the inner end of the second terminal 28 farthest to the left in FIGS. 1, 14 and 25 is connected to the third end 36 of the resistor body 24. Furthermore, the inner end of the fourth terminal 30 second from the right in FIGS. 1, 14 and 25 is connected to the fourth end 37 of the resistor body 24. The method of connecting the first, second, and fourth terminals 27, 28 and 30 to the first through fourth end 35 to 37 is the same as the abovementioned method for connecting the conducting plate 26 to the first end 34. The remaining third terminal 29 is provided at a location adjacent to but spaced apart from the conductor plate 26 (to the right thereof in FIGS. 1, 14 and 25 for the case of the illustrated example).

Figure 15:
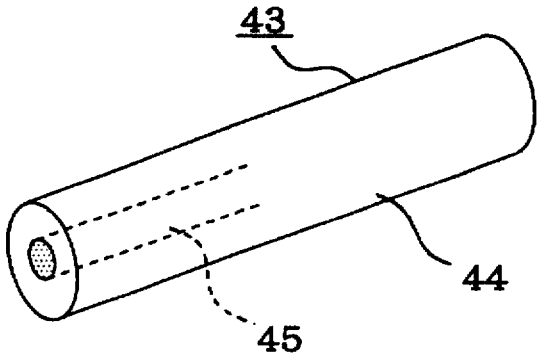
FIG. 15 is a perspective view of a flux cored solder which constitutes a fuse.
Figure 16:
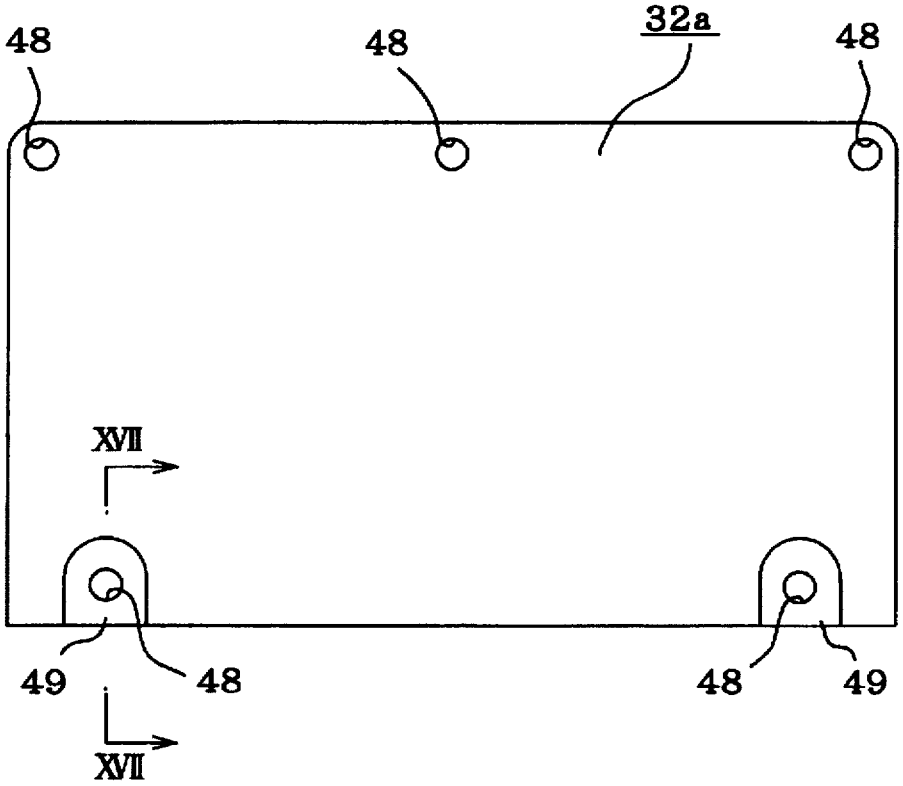
FIG. 16 is a front elevation view of one cover plate.
Figure 17:
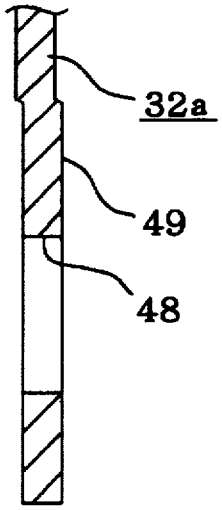
FIG. 17 is an enlarged cross-sectional view taken along the line XVII—XVII of FIG. 16.
Figure 18:
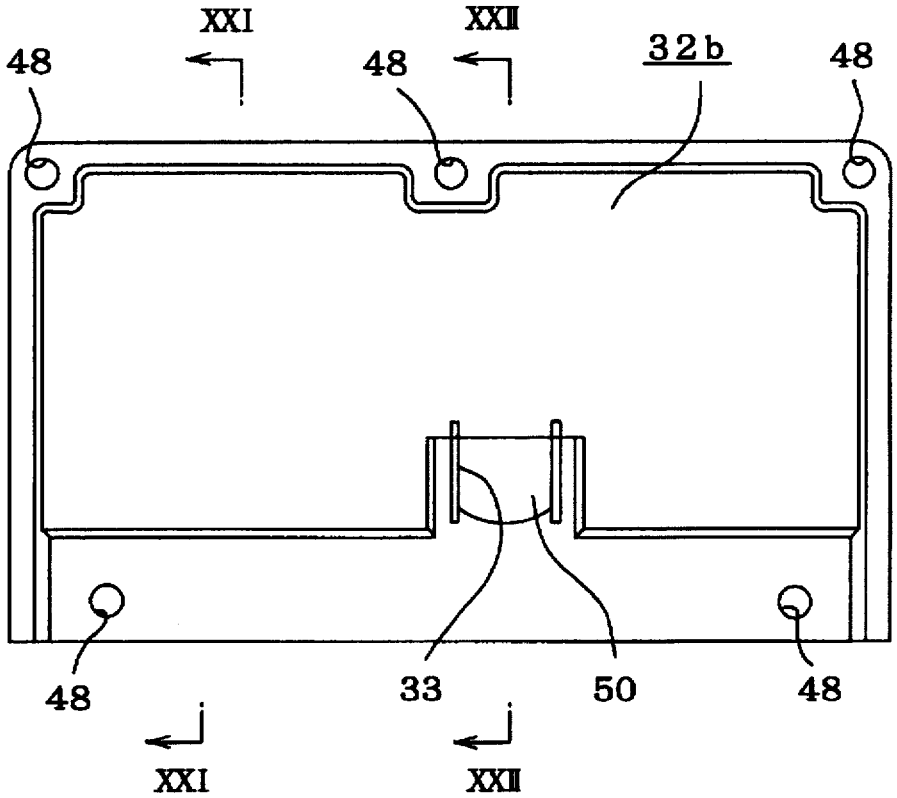
FIG. 18 is a rear elevational view of another cover plate.
Figure 19:
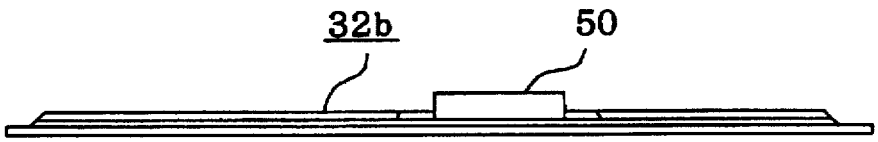
FIG. 19 is a plan view of FIG. 18.
Figure 20:
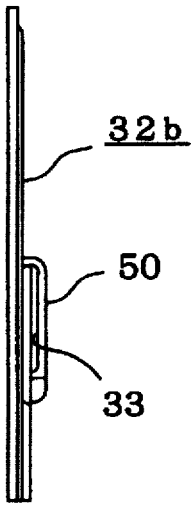
FIG. 20 is a right side view of FIG. 18.
Figure 21:
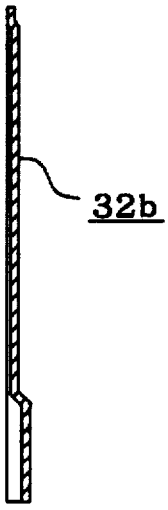
FIG. 21 is a cross-sectional view taken along the line XXI—XXI of FIG. 18.
Figure 22:
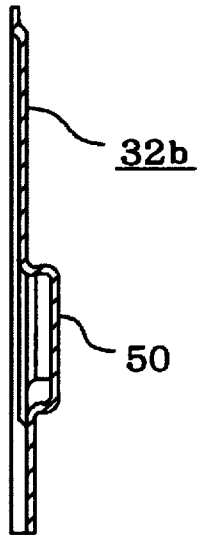
FIG. 22 is a cross-sectional view taken along the line XXII—XXII of FIG. 18.

The fuse 43 is bridged between the inner end of the third terminal 29 and the tip end of the conductor plate 26. With the present example, the fuse 43 uses a resin core solder such as shown in FIG. 15. That is to say, the fuse 43 has a flux 45 filling a central portion of a hollow tube of solder 44. When bridging the fuse 43 between the inner end of the third terminal 29 and the tip end of the conductor plate 26, the tube of solder 44 is soldered directly to the inner end of the third terminal 29 and the tip end of the conductor plate 26. This soldering operation is carried out by normal soldering and hence strict temperature control is not necessary. Moreover, at the time of soldering, the opposite end openings of the tube of solder 44 are closed off so that the flux 45 is sealed inside the fuse 43. With the opposite ends of the fuse 43 soldered in this way, then the third terminal 29 and the conductor plate 26 are electrically connected via the fuse 43.

Figure 4:
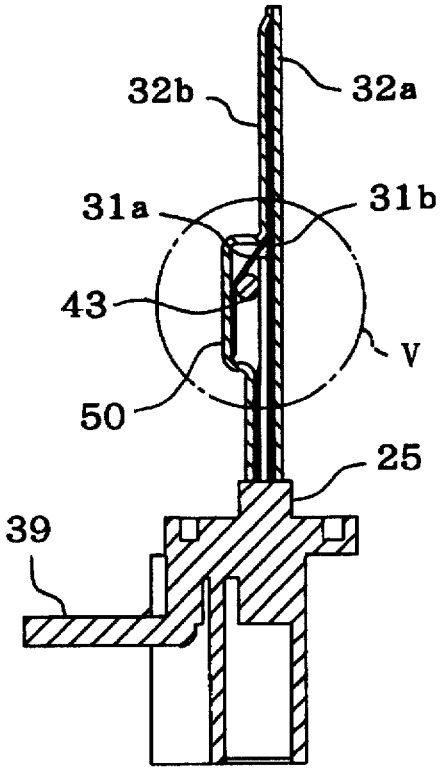
FIG. 4 is a cross-sectional view taken along the line IV—IV of FIG. 1.
Figure 5:
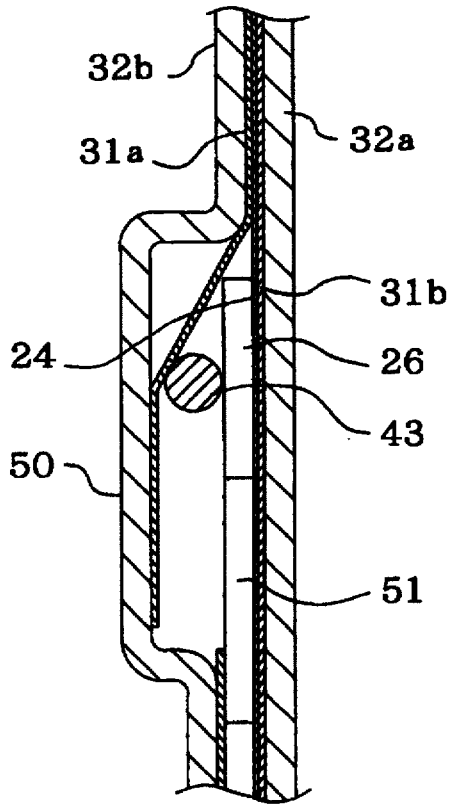
FIG. 5 is an enlarged view of part V of FIG. 4.
Figure 6:
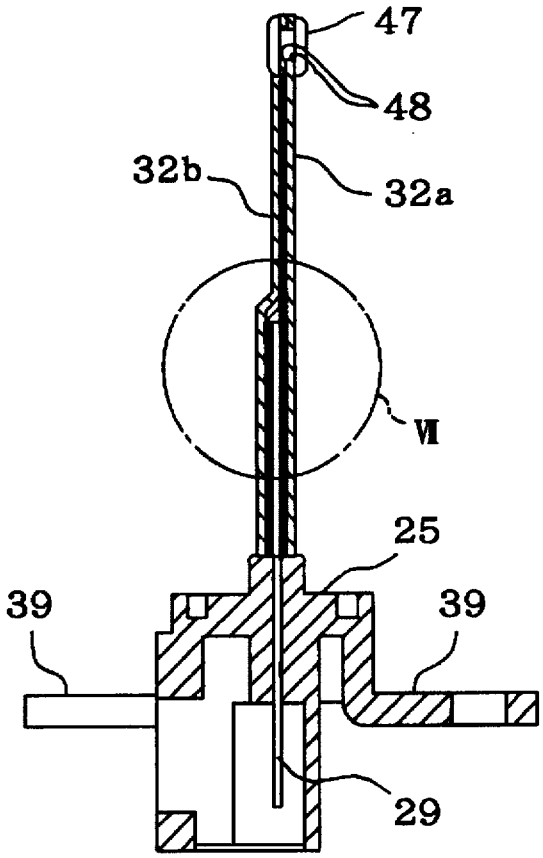
FIG. 6 is a cross-sectional view taken along the line VI—VI of FIG. 1, with a protruding portion omitted.
Figure 7:
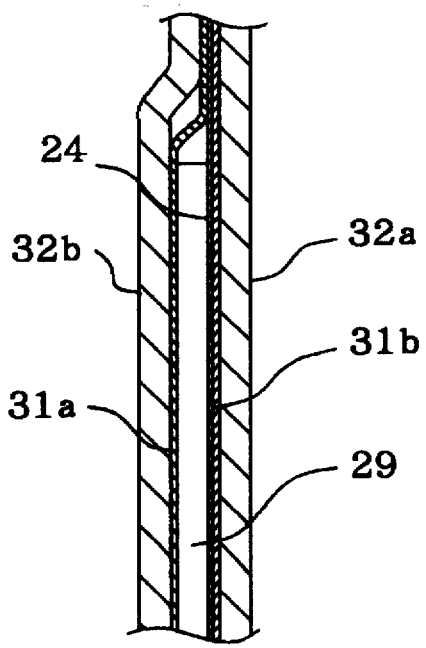
FIG. 7 is an enlarged view of part VII of FIG. 6.
Figure 8:
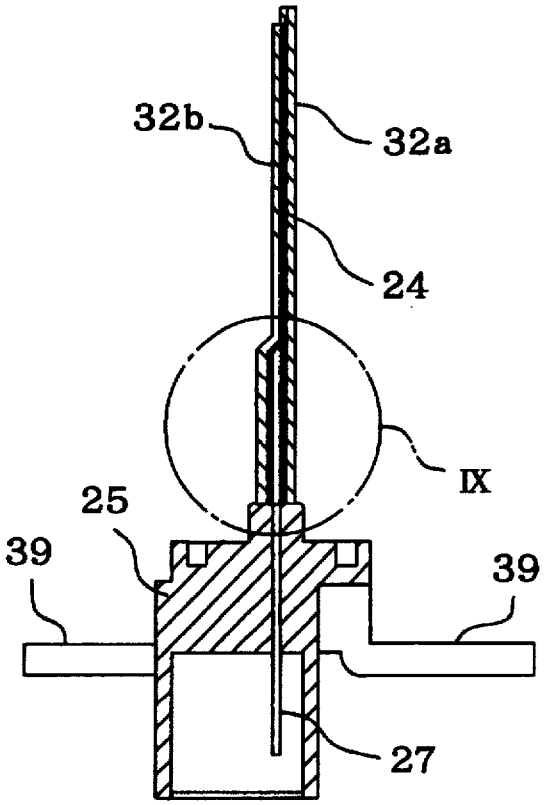
FIG. 8 is a cross-sectional view taken along the line VIII—VIII of FIG. 1 with the protruding portion omitted.
Figure 9:
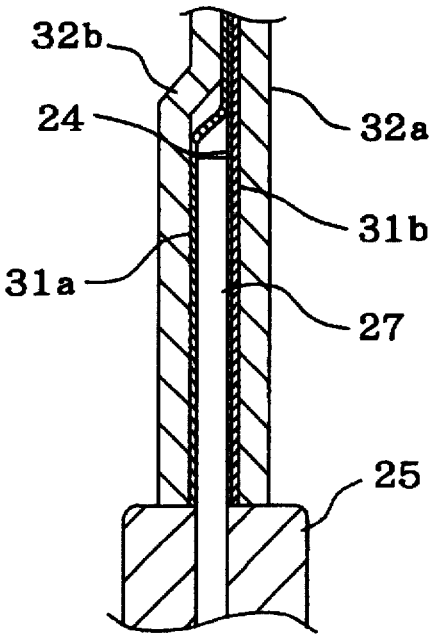
FIG. 9 is an enlarged view of part IX of FIG. 8.
Figure 10:
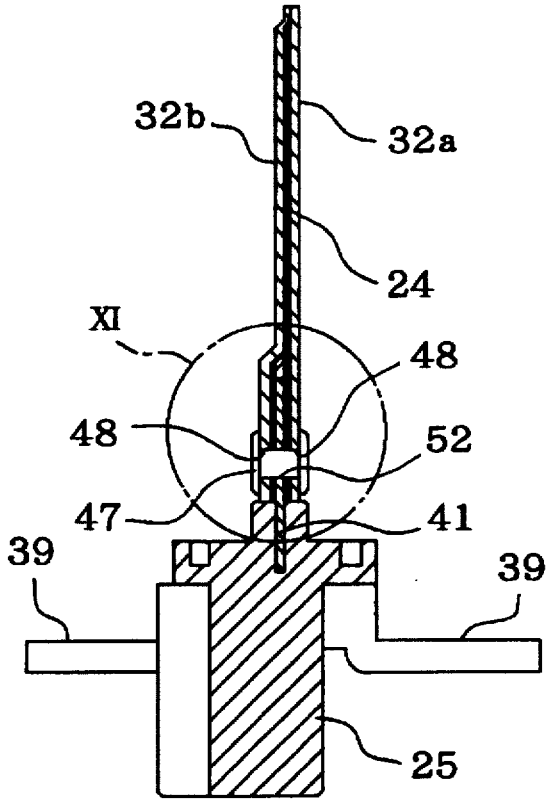
FIG. 10 is a cross-sectional view taken along the line X—X of FIG. 1 with the protruding portion omitted.
Figure 11:
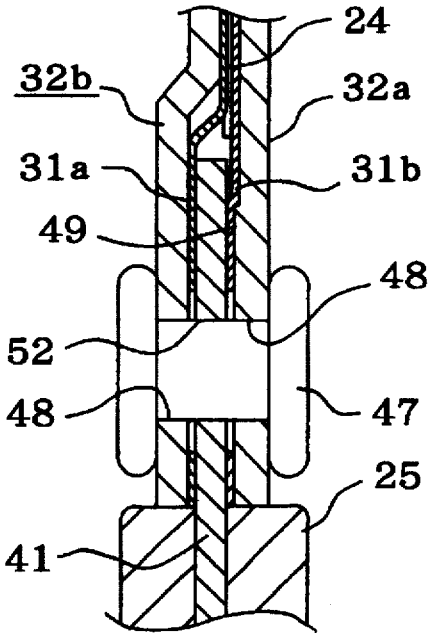
FIG. 11 is an enlarged view of part XI of FIG. 10.
Figure 23:
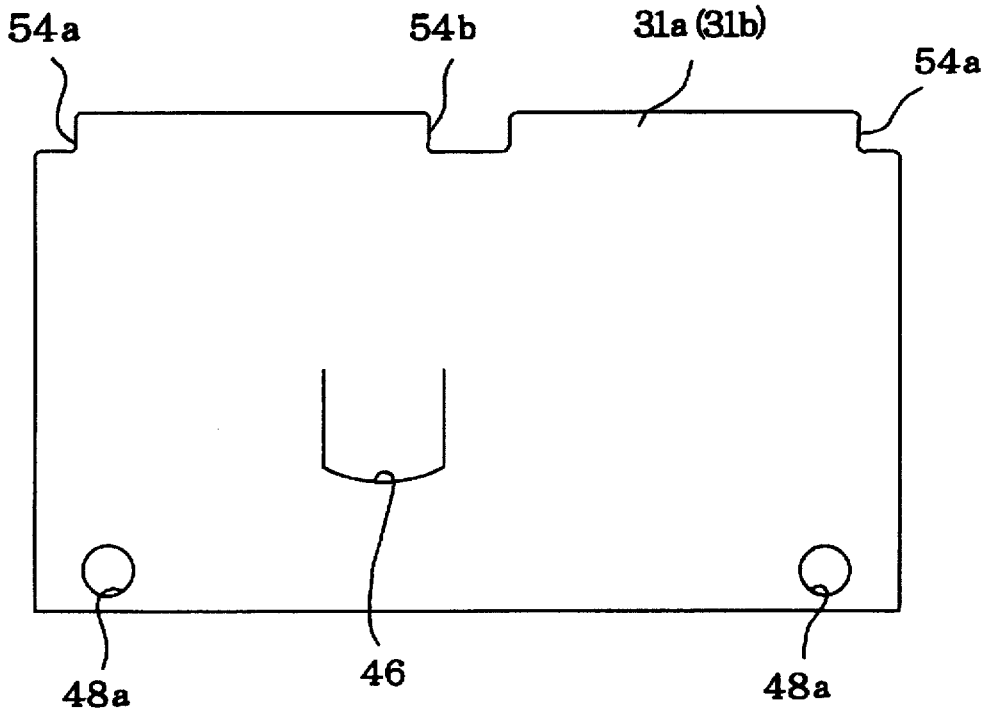
FIG. 23 is a front elevation view of an insulation sheet.
Figure 24:
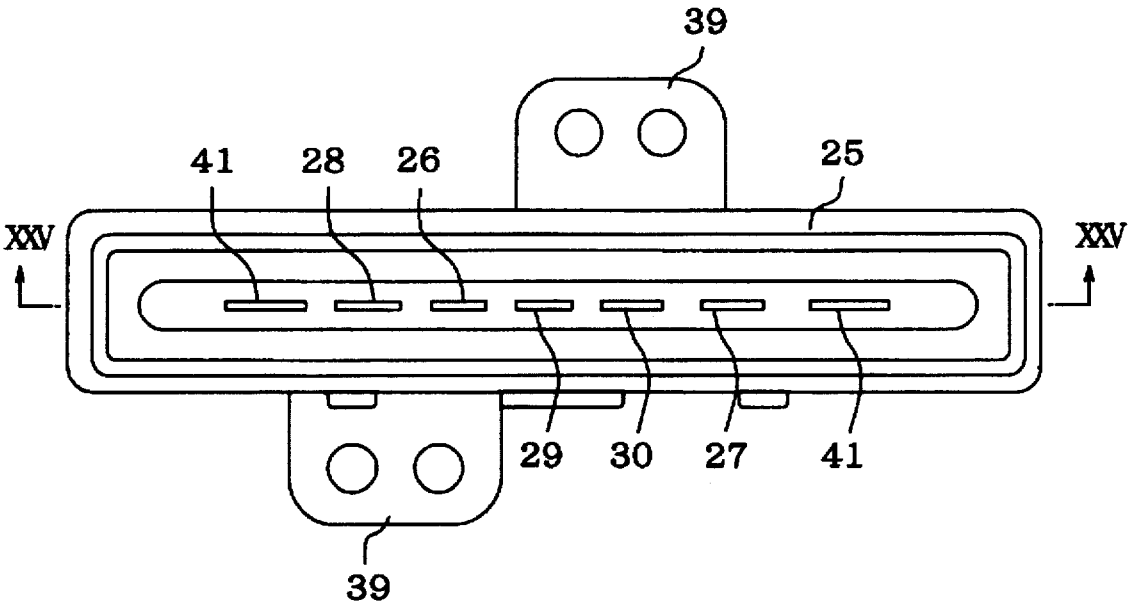
FIG. 24 is a plan view of the base with the conductor plate, the first through fourth terminals, and the attachment plates embedded therein.

The resistor body 24 constructed as described above, the tip half of the conductor plate 26 and the inner ends of the first through fourth terminals 27 to 30 supported on the base 25 so as to protrude from the inner face thereof as described above, and the fuse 43 spanned between the inner end of the third terminal 29 and the tip end of the conductor plate 26, are all clamped between the pair of cover plates 32*a*, 32*b* shown in FIGS. 16 to 22 with the pair of insulation sheets 31*a*, 31*b* shown in FIGS. 12 and 23 interposed therebetween. In this condition the insulation sheets 31*a*, 31*b* are, respectively, held between the inner face of the cover plates 32*a*, 32*b* and the respective members 24, 26 to 30, and 43 as shown in FIGS. 4, through 11, thus providing electrical insulation between the cover plates 32*a*, 32*b* and the respective members 24, 26 to 30 and 43. With respect to the pair of insulation sheets 31*a*, 31*b*, a portion of the insulation sheet 31*a* facing the fuse 43 is formed with a U-shape or channel shape cut 46, so that at the time of assembly, this portion is bent away from the fuse 43 as shown in FIGS. 4 and 5, thus avoiding that part of the insulation sheet 31*a* from propping. If the cut 46 is formed in both insulation sheets 31*a* and 31*b* this can avoid waisting time in locating the sheets 31*a*, 31*b* at the time of assembly.

The pair of cover plates 32*a*, 32*b* are made by press forming aluminium alloy plate, being a metal plate being good in heat conduction. Apertures 48 for receiving rivets 47

(FIGS. 1 to 3, 6, and 10 to 12) are formed in the cover plates 32*a*, 32*b* at five locations for mutual alignment, namely three locations on the side of tip end (on the side of upper end in FIGS. 1, 12, 16 and 18), that is at the opposite ends and a central location, and two locations on opposite ends on the side of base end (on the side of lower end in FIGS. 1, 12, 16 and 18).

In the case as shown in FIG. 23, respective cut-outs 54*a*, 54*b* and apertures 48*a* for providing space for the rivets 47, are formed in the insulation sheets 31*a*, 31*b*, at a locations in alignment with the respective apertures 48.

With respect to the pair of cover plates 32*a*, 32*b*, the cover plate 32*a* which is provided on the opposite side remote from the fuse 43 is formed, at the two opposite edge portions of the base edge thereof surrounding the apertures 48, with protrusions or lands 49 which respectively protrude by an amount equal to the plate thickness of the resistor body 24 (0.1 mm) towards the other cover plate 32*b*. Moreover, the other cover plate 32*b* provided on the side closer to the fuse 43, is formed, so that the region other than the tip edge rim and the opposite side edge rims, protrudes away from the cover plate 32*a*. Consequently, when the pair of cover plates 32*a*, 32*b* are overlapped, a gap for accommodating the resistor body 24 and the pair of insulation sheets 31*a*, 31*b* is formed therebetween. The protrusion amount at the base end portion of the cover plate 32*b*, except for at the opposite ends, is made larger than for the portion near the tip end, so that a gap is formed for accommodating the conductor plate 26, the first through fourth terminals 27 to 30, and a part of the attachment lugs 41 in addition to the resistor body 24 and the pair of insulation sheets 31*a*, 31*b*.

Moreover, a protrusion 50 is formed in a portion of the cover plate 32*b* at a location corresponding to the fuse 43, so as to protrude even further away from the cover plate 32*a*. The protrusion 50 has a portion between a pair of parallel slits deformed outwards with the slit portions-opened, so that when installed in the duct 1, the opening on the upstream side acts as the inlet opening 33. Air flowing over the outside of the cover plate 32*b* flows via the inlet opening 33 to inside of the protrusion 50, thereby cooling the fuse 43 located thereinside, after which it flows out via the downstream opening to outside of the cover plate 32*b*.

When the respective members of the above construction are assembled together to make up the resistor device, then as shown in FIGS. 1 through 11, the conductor plate 26 and the first through fourth terminals 27 to 30 which are secured to the base 25, and the resistor body 24 and the fuse 43 fixed to the respective members 26 to 30, are all held between the pair of insulation sheets 31*a*, 31*b*. The two insulation sheets 31*a*, 31*b* are then clamped from opposite sides by the pair of cover plates 32*a*, 32*b*, after which the cover plates 32*a*, 32*b* are secured together by the five rivets 47. The rivets 47 inserted at two locations on the opposite ends of the base of the two cover plates 32*a*, 32*b* are passed through the apertures 52 of the attachment plates 41 which are secured to the base 25, thereby securing the two cover plates 32*a*, 32*b* to the base 25.

Figure 28:
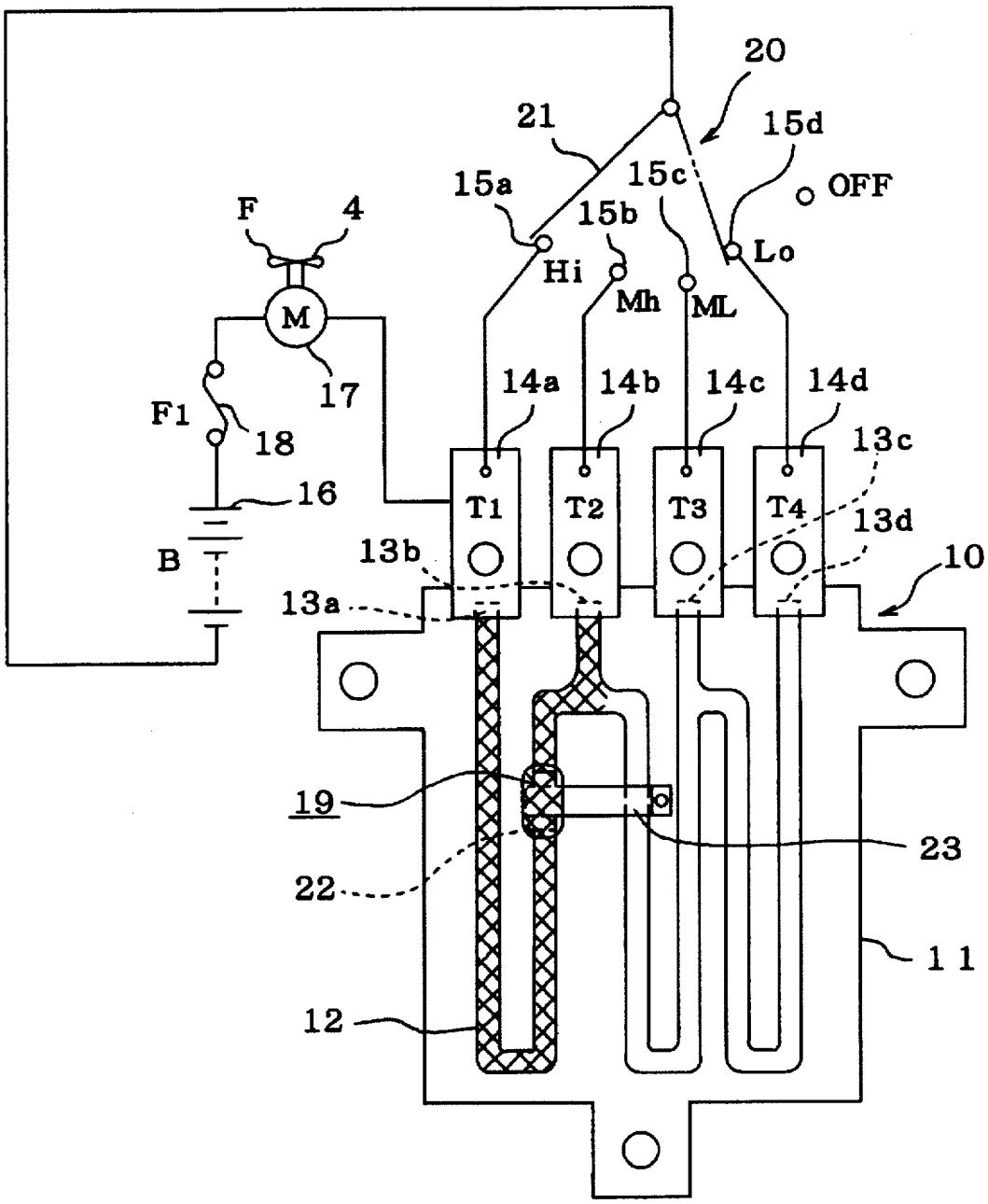
Fig 28 PRIOR ART
FIG. 28 is a plan view showing an example of a conventional resistor device.

The resistor device of the present invention constructed as described above, as with the beforementioned conventional resistor device, is assembled into the control circuit of the electric motor 17 of the fan 4 as shown for example in FIG. 28 with the resistor body 24 located above the base 25 as shown in Fits. 1, 3, 4, 6, 8 and 10, to thereby adjust the voltage applied to the electric motor 17. The operation in carrying out this adjustment is substantially the same as for the beforementioned conventional construction. The resistor device of the present invention is located inside the duct 1 of the automotive air conditioning unit, as with the conventional resistor device, and aligned so as not to present a large resistance to the air flowing in the duct 1. That is to say, when the resistor device of the present invention is positioned in the duct 1, the air flows in left—right directions in Fits. 1 and 2 and front—rear directions in FIGS. 3 though 11. Consequently, with the resistor device of the present invention, the air flowing in the duct 1 is efficiently introduced via the inlet opening 33 to inside the protrusion 50 formed in the cover plate 32*b*, and then flows out from the protrusion 50. With the example shown in the figures, the shape of the respective portions etc. are determined so that the resistor body 24 etc. are positioned above the base 25, as shown in FIGS. 1, and 3 through 11.

With the fan 4 operating normally, then while the air is flowing in the duct 1, the fuse 43 provided inside the protrusion 50 of the cover plate 32*b* is cooled by air which is introduced to inside the protrusion 50 via the inlet opening 33 and then discharged. The fuse 43 therefore does not melt. On the other hand, when the fan 4 does not rotate in spite of power being supplied thereto, then as described hereunder, the fuse melt down so that the power supply to the electric motor 17 for driving the fan 4 stops.

If the fan 4 stops so that the air ceases to flow in the duct 1, cooling air is not supplied via the inlet opening 33 to the interior portion of the protrusion 50 housing the fuse 43. The resistor body 24 however continues to produce Joule heat due to the continuation of power to the electric motor 17 for driving the fan 4. This heat is transmitted through the aluminium alloy cover plates 32*a*, 32*b* to the mounting portion of the fuse 43 so that the temperature of the fuse 43 increases. As a result, the fuse 43 melts, disconnecting the conductor plate 26 and the third terminal 29 and stopping the power supply to the electric motor 17 for driving the fan 4, thus preventing damage to the electric motor 17.

With the embodiment shown in the figures, since the fuse 43 is made from solder 44 with flux 45 contained therein, fitting of the fuse 43 can be easily carried out without the need for troublesome temperature control, and moreover the fuse 43 reliably melts at the time of a temperature increase. To explain further, when the solder 44 has been left for a long time, an oxide film with a higher melting point than the melting point of the solder itself is formed on the surface of the solder 44. As a result, if the fuse 43 is simply made from solder, then even if the solder melts with a rise in temperature, the conductor plate 26 and the third terminal 29 can remain connected due to the melted solder which is still sealed inside a thin tube of the oxide film. On the other hand, with the embodiment shown in the figures, the flux 45 sealed inside the solder 44 breaks down the oxide film (reduces the melting point of the oxide film so that the oxide film melts). Therefore at the time of a temperature rise, the connection between the conductor plate 26 and the third terminal 29 is reliably broken. Moreover, since the construction is such that the fuse 43 is not directly connected to the resistor body 24 which is made from an easily distorted very thin plate, then from this point also, the fuse fitting operation can be easily carried out. The abovementioned effect due to using resin core solder, can be obtained not only with the construction of the present invention, but also with other constructions wherein a fuse is provided in an electrical circuit.

With the example shown in the figures, cut-outs 51 are formed in the conductor plate 26 and the third terminal 29 in central portions of mutually facing edges, thereby widening the gap between the edges of the conductor plate 26 and the third terminal 29. With this construction, then even if only part of the solder 44 of the fuse 43 melts at the time of a temperature rise, the conductor plate 26 and the third terminal 29 are reliably disconnected. That is to say, considering a situation wherein one end of the solder 44 of the fuse 43 is completely melted due to a rise in the temperature while the other end is only half melted. In this case the fuse 43 inclines, supported by one end with the other end hanging down. When the fuse 43 is inclined in this way, if the space between the edges of the conductor plate 26 and the third terminal 29 is too narrow, then the two members 26, 29 can remain connected. To avoid this undesirable situation, the spacing between the edges of the conductor plate 26 and the third terminal 29 can be widened. However simply increasing the spacing between the two members 26, 29 causes an increase in the size of the resistor device. On the other hand, with the example shown in the figures, the effective spacing between the conductor plate 26 and the third terminal 29 at their end edges is widened by the cut-outs 51, thus enabling the two members 26, 29 to be reliably disconnected at the time of a temperature rise, without an increase in size of the resistor device.

In this way, with the resistor device of the present invention, while the construction is such that the fuse 43 can be located away from the resistor body 24, when the rotation of the fan 4 stops while under power, the temperature of the fuse 43 can still be effectively raised by heat from the resistor body 24 and reliably melted. Moreover, since the fuse 43 can be located away from the resistor body 24, then under normal times, the fuse 43 is not easily influenced by heat from the resistor body 24 so that the life of the fuse 43 can be improved.

The resistor body 24 is made for example by etching a stainless steel plate, in a form of a separate thin plate. It is thus not necessary to form the resistor body on the surface of an enameled plate (insulation substrate) as with the conventional construction. Consequently, the number of manufacturing steps is reduced so that costs can be reduced. Moreover, the operation of installing the fuse 43 between the third terminal 29 and the conductor plate 26 is carried out by normal soldering thus avoiding troublesome temperature control. Consequently, costs can also be reduced from the point of view of temperature control at the time of fitting the fuse 43.

Figure 26:
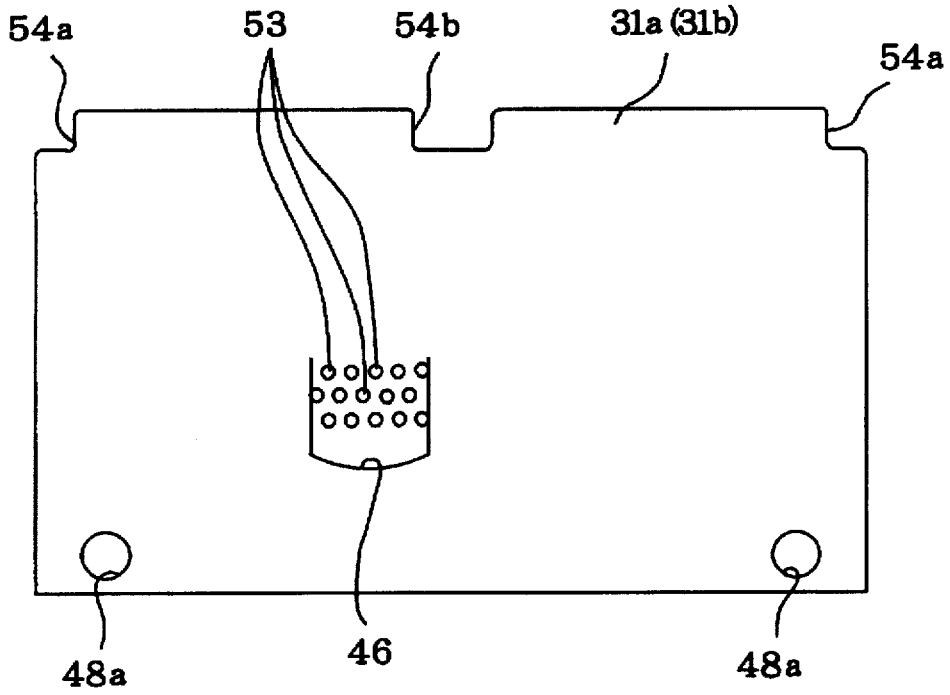
FIG. 26 is a front elevation view showing another example of an insulation sheet.

In order to make the fuse 43 melt faster and more reliably when the fan 4 stops, then as shown in FIG. 26, a portion of the insulation sheet 31*a* facing the fuse 43, that is to say the portion surrounded by the cut 46, can be formed with a plurality of small holes 53. These small holes 53 have the role of effectively transmitting the heat in the cover plate 32*a* to the fuse 43 when the temperature of the cover plate 32*a* rises with stoppage of the fan 4. That is to say, as well as electrical insulation, the sheet 31*a* also has a certain amount of heat insulation (thermal insulation). Consequently, when the insulation sheet 31*a* shown in FIG. 23 is used, then even if the temperature of the cover plate 32*a* rises with stoppage of the fan 4, a certain amount of time is required until the fuse 43 melts. On the other hand, if as shown in FIG. 26, a plurality of small holes 53 are formed in the portion of the insulation sheet 31*a* facing the fuse 43, then the heat of the cover plate 32*a* can be effectively transmitted to the fuse 43, thus shortening the time required for the fuse 43 to melt after stoppage of the fan 4.

The abovedescribed small holes 53 are preferably formed not only in the portion of the insulation sheet 31*a* which directly faces the fuse 43 but also in the portion of the insulation sheet 31*b* which faces the fuse 43 via the conductor plate 26, the third terminal 29 and the resistor body 24. By thus forming small holes 53 not only in the insulation sheet 31*a* but also in the insulation sheet 31*b*, then the heat from the pair of cover plates 32*a*, 32*b* can be transmitted to the fuse 43 from opposite sides of the fuse 43, so that the fuse 43 can be quickly and reliably melted.

Moreover, as well as the small holes being formed in the portion of the insulation sheets 31*a*, 31*b* facing the fuse 43, small holes can also be formed in the portions facing the resistor body 24. By forming the small holes in this way in the portions facing the resistor body 24, then the heat of the resistor body 24 can be effectively transmitted to the respective cover plates 32*a*, 32*b*. As a result, the temperature rise of the respective cover plates 32*a*, 32*b* at the time of stoppage of the fan 4 can be hastened so that the time required for the fuse 43 to melt after stoppage of the fan 4 can be even further shortened. In either case, with reference to the small holes 53 formed in the respective insulation sheets 31*a*, 31*b*, no small protuberance is formed on adjacent electrical conducting parts on opposite sides of the insulation sheets 31*a*, 31*b* so as to enter the small holes 53. Consequently, the insulation of the adjacent parts is not marred due to The presence of the small holes 53. In other words the holes cannot be made too large, since this could result in breakdown of the insulation.

As a result of the above described construction and operation of the resistor device of the present invention, the reliability of an automotive air-conditioning unit fitted therewith can be further improved, with a reduction in costs.

What is claimed is:

1. A resistor device comprising:

a resistor body having at least first, second and third ends with a first resistance value provided between the first and second ends and with a second resistance value different from the first resistance value provided between the first and third ends, a base of insulation material, a conductor member having a base half portion embedded in the base and a tip half portion exposed from the base and connected to the first end, a first terminal having a central portion embedded in the base and an inner end portion connected to the second end, a second terminal having a central portion embedded in the base and an inner end portion connected to the third end, a third terminal provided adjacent and away from the conductor member and having an central portion embedded in the base, a fuse provided between the third terminal and the conductor member, a pair of insulation sheets for holding the fuse, the resistor body, the inner end portions of the first to third terminals and the tip half portion of the conductor member therebetween, and a pair of cover plates made of a metal with a good thermal conductivity to hold the insulation sheets therebetween, such that air flows outside the cover plates and that one of the cover plates has an inlet opening formed at a portion corresponding to the fuse to introduce part of the air to inside the cover plates.

* * * * *